US007572307B2

(12) United States Patent
Coburn

(10) Patent No.: US 7,572,307 B2
(45) Date of Patent: Aug. 11, 2009

(54) FILTER ASSEMBLY FOR VACUUM CLEANER AND VACUUM CLEANER INCORPORATING SUCH ASSEMBLY

(75) Inventor: Eric Coburn, Coxhoe (GB)

(73) Assignee: Black & Decker Inc., Newark, DE (US)

( * ) Notice: Subject to any disclaimer, the term of this patent is extended or adjusted under 35 U.S.C. 154(b) by 462 days.

(21) Appl. No.: 11/047,405

(22) Filed: Jan. 31, 2005

(65) Prior Publication Data

US 2005/0183406 A1 Aug. 25, 2005

(30) Foreign Application Priority Data

Feb. 10, 2004 (GB) ..... 0402847.8

(51) Int. Cl.
*A47L 9/10* (2006.01)
*A47L 5/24* (2006.01)

(52) U.S. Cl. ..... 55/332; 55/373; 55/337; 55/413; 55/426; 55/486; 55/459.1; 55/487; 55/DIG. 3

(58) Field of Classification Search ..... 55/332, 55/373, 337, 413, 426, 486, 459.1, 487, DIG. 3; 15/347, 351, 359, 353
See application file for complete search history.

(56) References Cited

U.S. PATENT DOCUMENTS

| | | | | |
|---|---|---|---|---|
| 4,213,224 | A | 7/1980 | Miller | |
| 4,592,764 | A | 6/1986 | Ikezaki et al. | |
| 4,831,685 | A * | 5/1989 | Bosyj et al. | 15/344 |
| 6,110,248 | A | 8/2000 | Liu | |
| 6,314,610 | B1 * | 11/2001 | Miller et al. | 15/347 |
| 6,434,785 | B1 | 8/2002 | Vandenbelt et al. | |
| 6,546,592 | B1 | 4/2003 | Cockburn et al. | |
| 7,086,119 | B2 * | 8/2006 | Go et al. | 15/353 |
| 7,135,051 | B2 * | 11/2006 | Baldinger et al. | 55/337 |
| 7,185,394 | B2 * | 3/2007 | Hafling et al. | 15/347 |
| 7,260,867 | B2 * | 8/2007 | Overvaag | 15/347 |
| 7,325,274 | B2 * | 2/2008 | Jeong | 15/352 |
| 2004/0163368 | A1 | 8/2004 | Lee et al. | |

FOREIGN PATENT DOCUMENTS

| | | |
|---|---|---|
| EP | 1 070 478 A2 | 1/2001 |
| GB | 2 305 113 A | 4/1997 |
| JP | 2004160150 | 6/2004 |

* cited by examiner

*Primary Examiner*—Jason M Greene
*Assistant Examiner*—Minh-Chau T Pham
(74) *Attorney, Agent, or Firm*—John Yun; Bruce S. Shapiro; Wesley Muller

(57) ABSTRACT

A filter apparatus and a vacuum cleaner incorporating the filter apparatus are disclosed. The filter apparatus has a first, fine filter assembly and a second, coarse filter assembly. The fine filter assembly includes a body defining a central aperture in which a pleated fine filter element is arranged. The periphery of aperture is surrounded by a resilient rubber sealing member. Apertures are arranged around the body portion radially outwards of the aperture and sealing member for mounting the fine filter assembly to pins on housing of the vacuum cleaner. The body is also provided with radially inwardly facing slots for engaging corresponding projections on a coarse filter assembly for removably mounting the coarse filter assembly to the fine filter assembly. The removable coarse filter assembly gives the user a choice between two stage filtration (i.e. using the fine and course filter assemblies) or single stage filtration (i.e. using the fine filter assembly only).

15 Claims, 9 Drawing Sheets

PRIOR ART

FILTER ASSEMBLY FOR VACUUM CLEANER AND VACUUM CLEANER INCORPORATING SUCH ASSEMBLY

FIELD OF THE INVENTION

The present invention relates to filter assemblies for vacuum cleaners, and to vacuum cleaners incorporating such filter assemblies. The invention relates particularly, but not exclusively, to filter assemblies for handheld vacuum cleaners, and to handheld vacuum cleaners incorporating such assemblies.

BACKGROUND OF THE INVENTION

Handheld, portable vacuum cleaners are known in which a two-stage filtration process, i.e. coarse filtration of air passing through the vacuum cleaner, followed by fine filtration, is carried out. A filter apparatus of a vacuum cleaner of this type is shown in FIGS. 1 to 4. A vacuum cleaner 2 has a housing 4 containing a motor (not shown) for driving a fan (not shown) having an air inlet 6. A filter apparatus 8 includes a coarse filter assembly 10 having a cup-shaped body 12 having apertures 14, and a resilient rubber seal 16 is provided around the periphery of the body 12. A pair of apertures 18, each of which comprises a smaller portion 20 and a larger portion 22, are provided on opposite sides of the periphery of the body 12, and resilient rubber seals 24 surround each aperture 18.

A fine filter assembly 26 comprises a body 28 having a shape corresponding to that of coarse filter assembly 10 and has a central aperture 30 in which a pleated filter element 32 of suitable fibrous material which will be familiar to persons skilled in the art is arranged. A pair of apertures 34, corresponding in shape to the apertures 18 at the periphery of coarse filter assembly 10, are provided on opposite sides of the periphery of body 28.

In order to assemble the filter apparatus comprising the coarse filter assembly 10 and fine filter assembly 26 and mount it to the housing 4 of the vacuum cleaner, the fine filter element 32 of the fine filter assembly 26 is placed inside the coarse filter assembly 10 such that apertures 34 overlie apertures 18, and the apertures 18, 34 are placed over corresponding pins 36 on housing 4. As can been seen particularly from FIG. 1, the pins 36 have enlarged heads which pass through the wider portions 22 of apertures 18, and the coarse filter assembly 10 is then rotated slightly relative to housing 4 to engage the shaft of pins 36 with the narrow portions 20 of apertures 18 to prevent removal of the coarse filter assembly 10, and thereby also of the fine filter assembly 26, from the housing 4. In this way, air entering into air inlet 6 is forced to pass through coarse filter assembly 10 and fine filter assembly 26 before it reaches the fan of the vacuum cleaner.

It would be desirable to provide a vacuum cleaner having the possibility of selection between single stage filtering and two stage filtering. For example, filtering via coarse filter assembly 10 and fine filter assembly 26 of the arrangement of FIGS. 1 to 4 involves more effective filtering but lower throughput of air than an arrangement in which the coarse filter assembly 10 is removed and only the fine filter assembly 26 is mounted to the housing 4. However, an attempt to provide single stage filtering (i.e. using only the fine filter assembly 26) in the arrangement of FIGS. 1 to 4 leads to a number of drawbacks. Firstly, apertures 34 of fine filter assembly 26 only prevent the passage of unfiltered dirt-carrying air when seals 24 surrounding apertures 18 of coarse filter assembly 10 are placed under compression. However, this can only occur when the coarse filter assembly 10 is also mounted to the pins 36, since the length of pins 36 and the presence of seals 24 around apertures 18 on coarse filter assembly 10 only means that when only the fine filter assembly 26 is mounted to pins 36, air containing dirt particles can enter air inlet 6 via apertures 34 without first passing through the fine filter element 32. This can lead to damage to the motor of the vacuum cleaner 2. Furthermore, because the apertures 18 on coarse filter assembly 10 and apertures 34 on fine filter assembly 28 are designed to be mounted to pins 36, it is possible for a user to mount coarse filter assembly 10 directly to housing 4 without fine filter assembly 28 being present. This can also lead to intake of air containing dirt particles into air inlet 6, leading to damage to the motor.

Preferred embodiments of the present invention seek to overcome the above disadvantages of the prior art.

BRIEF SUMMARY OF THE INVENTION

According to an aspect of the present invention, there is provided a first filter assembly for a vacuum cleaner having a housing, at least one air inlet, at least one air outlet, and suction means for causing air to flow from at least one said inlet to at least one said outlet, the filter assembly comprising:

a body portion having at least one first aperture therethrough and at least one filter element arranged in the or each said first aperture for substantially preventing passage of particles larger than a first predetermined particle size;

first mounting means on said body portion for enabling the body portion to be removably mounted to the housing of the vacuum cleaner;

second mounting means for enabling a second filter assembly to be removably mounted to said body portion; and sealing means for preventing passage of air into the suction means of the vacuum cleaner without previously having passed through a said filter element.

By providing a first filter assembly having second mounting means for enabling a second filter assembly to be removably mounted to the body portion of the first filter assembly, this provides the advantage of enabling a user of a vacuum cleaner incorporating the first filter assembly to choose between two stage filtration, i.e. by means of the first and second filter assemblies, or one stage filtration, i.e. by means of the first filter assembly only. For example, the first filter assembly may be a fine filter assembly, and the second filter assembly may be a coarse filter assembly.

The first mounting means may comprise at least one aperture and/or protrusion on said body portion adapted to engage a respective protrusion and/or aperture on the housing.

At least one said aperture may comprise a first portion for enabling removal of the aperture from the corresponding said protrusion when engaged therewith, and a second portion, narrower than said first portion, for preventing removal of the aperture from the corresponding said protrusion when engaged therewith.

The sealing means may surround the or each said aperture and/or protrusion of said first mounting means.

The first mounting means may comprise a plurality of said apertures and/or protrusions circumferentially spaced around said body portion radially outwards of the or each said first aperture.

This provides the advantage of providing a stable mounting of the body portion to the housing of the vacuum cleaner.

The second mounting means may comprise at least one aperture and/or projection on said body portion for engaging a respective projection and/or aperture on the second filter assembly.

Said second mounting means may comprise at least one slot and/or protrusion on said body portion for engaging a respective said protrusion and/or slot on the second filter assembly.

The sealing means may comprise at least one resilient member surrounding the or each said first aperture.

This provides the advantage of making it unnecessary for the sealing means to surround the or each aperture and/or protrusion on the body portion.

The sealing means may comprise a single said resilient member surrounding the or each said first aperture.

The first mounting means may be shaped and/or sized and/or spaced around said body portion so as to prevent the second filter assembly from being mounted thereto.

The second mounting means may be shaped and/or sized and/or spaced around said body portion so as to prevent the second filter assembly from being mounted directly to the housing of the vacuum cleaner.

This provides the advantage of preventing the second filter assembly from being mounted directly to the housing of the vacuum cleaner, which could result in damage to the motor of the vacuum cleaner as a result of intake of insufficiently filtered air in the case where the first filter assembly is a fine filter and the second filter assembly is a coarse filter.

The assembly may further comprise third mounting means for enabling at least one third filter assembly to be removably mounted to said first filter assembly for preventing entry of air into the second filter assembly without previously having passed through the third filter assembly.

The third mounting means may be shaped and/or sized and/or spaced around said body portion so as to prevent the third filter assembly from being mounted directly to the housing of the vacuum cleaner.

According to another aspect of the present invention, there is provided a second filter assembly for a vacuum cleaner having a housing, at least one air inlet, at least one air outlet, and suction means for causing air to flow from at least one said inlet to at least one said outlet, the filter assembly comprising:

a body portion having a plurality of apertures for substantially preventing passage of particles larger than a second predetermined particle size; and first mounting means provided on said body portion for enabling the body portion to be removably mounted to a first filter assembly adapted to be mounted to the housing of the vacuum cleaner such that air having passed through said second filter assembly is prevented from passing into said suction means without first passing through the first filter assembly.

By providing a second filter assembly which is adapted to be mounted to a first filter assembly, this provides the advantage that the second filter assembly can be removed, while leaving the first filter assembly in place mounted to the housing of a vacuum cleaner incorporating the filter assembly. This provides the advantage of giving the user a choice between one stage filtration (i.e. by means of the first filter assembly only) or two-stage filtration (i.e. by means of the first and second filter assemblies).

The first mounting means may comprise a plurality of protrusions and/or apertures on said body portion adapted to engage respective apertures and/or protrusions on the first filter assembly.

The first mounting means may comprise at least one slot and/or protrusion on said body portion for engaging a respective said protrusion and/or slot on the first filter assembly.

The assembly may further comprise third mounting means for enabling at least one third filter assembly to be removably mounted to said second filter assembly for preventing entry of air into the second filter assembly without previously having passed through the third filter assembly.

The third mounting means may be shaped and/or sized and/or spaced around said body portion so as to prevent the third filter assembly from being mounted directly to the housing of the vacuum cleaner.

According to a further aspect of the present invention, there is provided a filter apparatus for a vacuum cleaner having a housing, at least one air inlet, at least one air outlet, and suction means for causing air to flow from at least one said inlet to at least one said outlet, the filter apparatus comprising:

a first filter assembly adapted to substantially prevent passage of particles larger than a first predetermined particle size; and a second filter assembly adapted to substantially prevent passage of particles larger than a second predetermined particle size, larger than said first predetermined particle size, wherein said second filter assembly is adapted to be removably mounted to said first filter assembly.

The apparatus may comprise a first filter assembly as defined above and a second filter assembly as defined above.

The apparatus may comprise at least one third filter assembly adapted to be removably mounted to said first and/or said second filter assembly for preventing entry of air into the second filter assembly without previously having passed through the third filter assembly.

The third filter assembly may comprise fourth mounting means for enabling said third filter assembly to be removably mounted to said first and/or second filter assembly.

The fourth mounting means may be shaped and/or sized and/or spaced around said body portion so as to prevent the third filter assembly from being mounted directly to the housing of the vacuum cleaner.

According to a further aspect of the present invention, there is provided a vacuum cleaner comprising a housing, at least one air inlet, at least one air outlet, suction means for causing air to flow from at least one said inlet to at least one said outlet, and a filter apparatus as defined above arranged between the or each said inlet and said suction means.

BRIEF DESCRIPTION OF THE DRAWINGS

A preferred embodiment of the invention will now be described, by way of example only and not in any limitative sense, with reference to the accompanying drawings, in which.

DETAILED DESCRIPTION OF THE INVENTION

Figure 1:
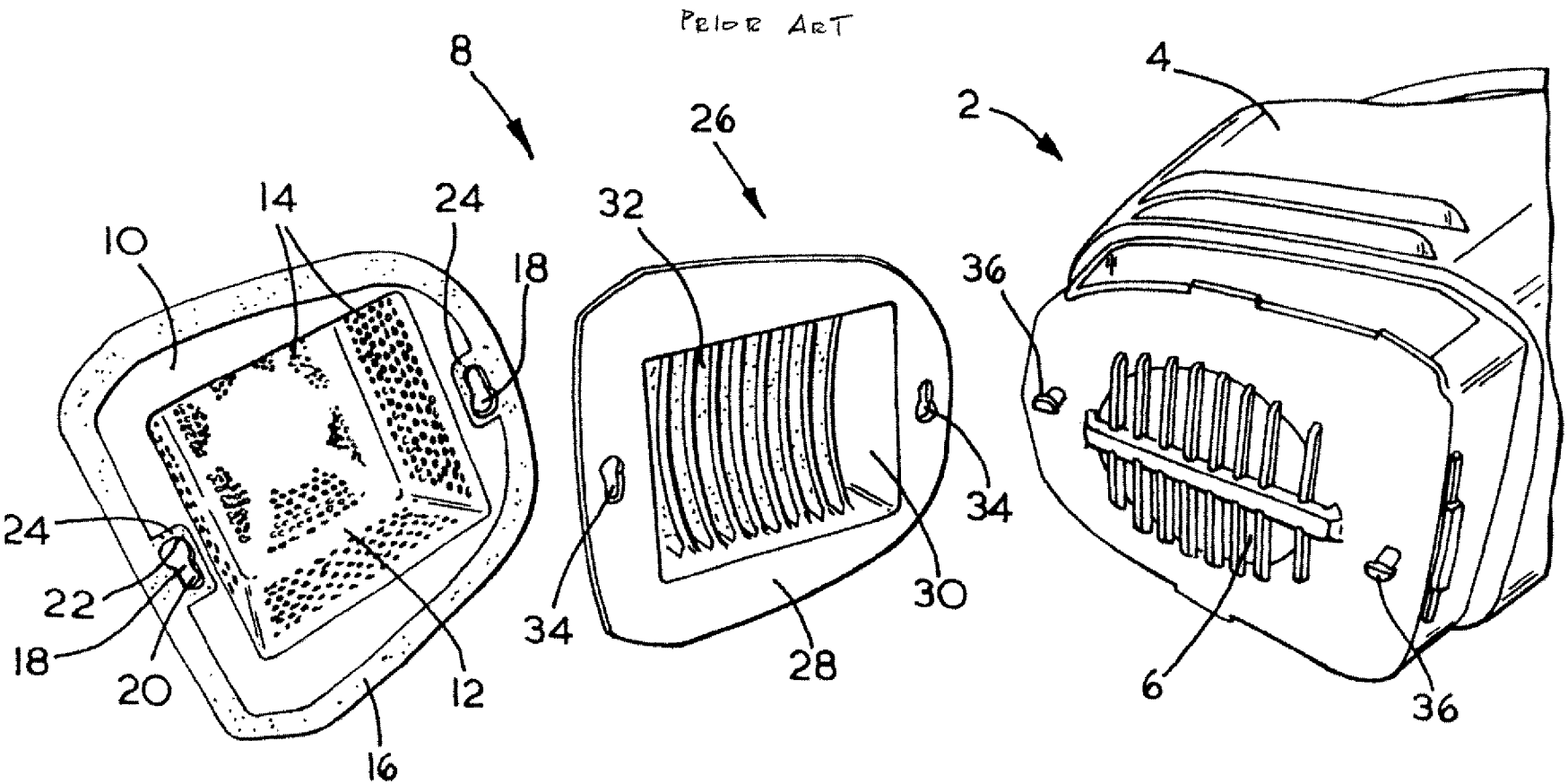
FIG. 1 is perspective view of a dismantled filter apparatus and housing of a prior art vacuum cleaner.
Figure 2:
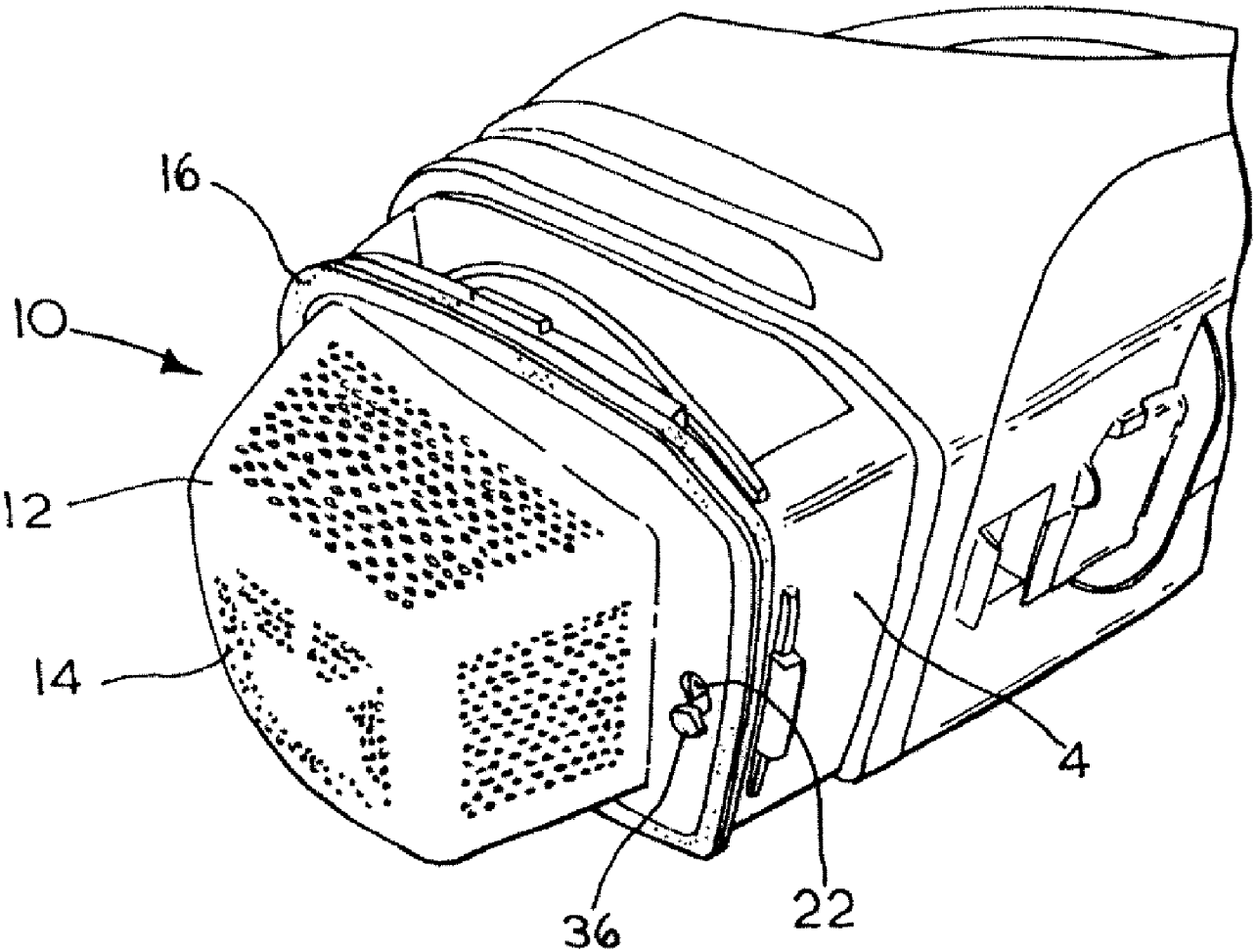
FIG. 2 PRIOR ART
FIG. 2 is a perspective view of the filter apparatus and housing of FIG. 1 in its assembled condition.
Figure 3:
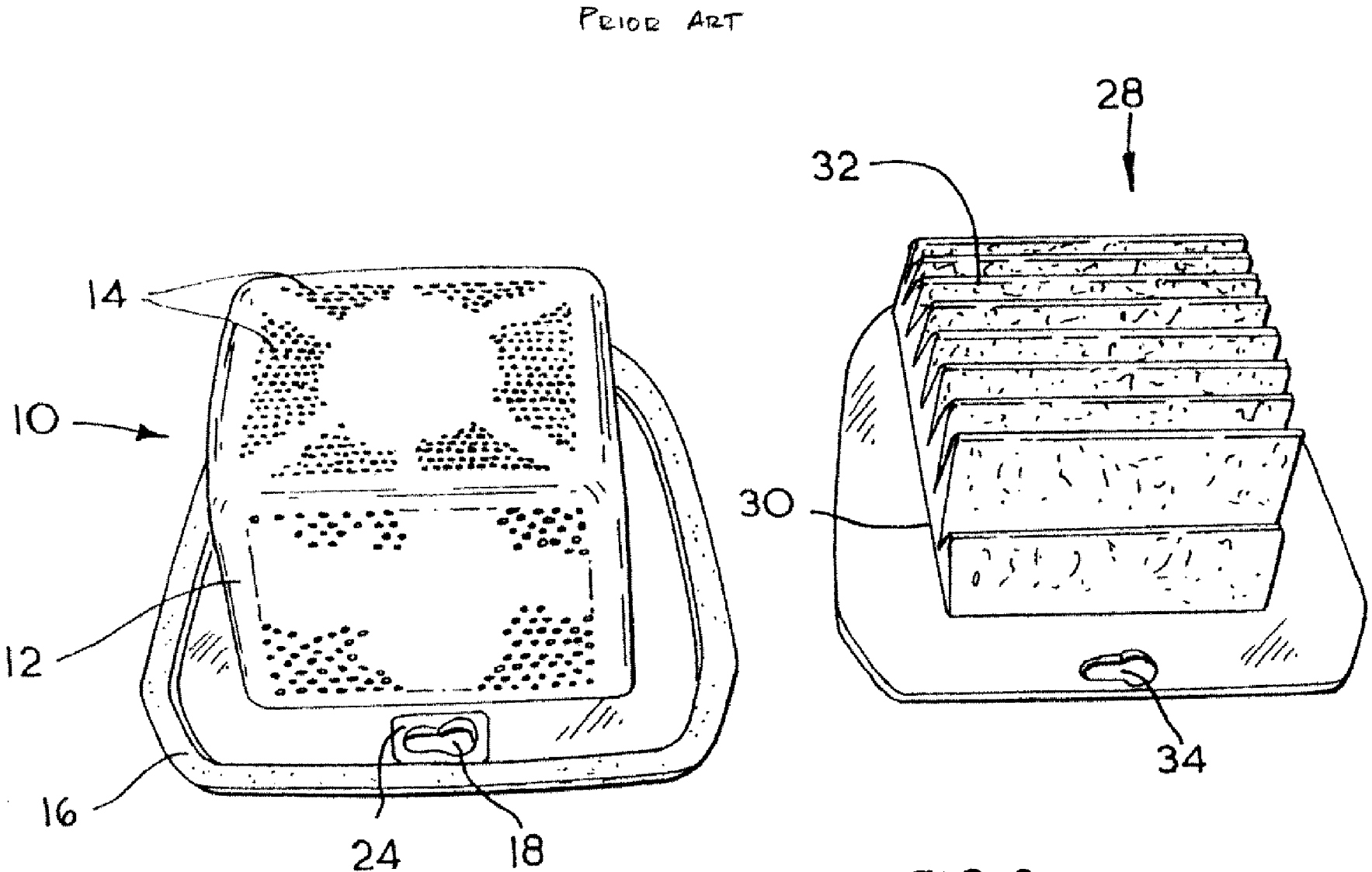
FIG. 3 is a perspective view of the coarse and fine filters of the filter apparatus of FIG. 1.
Figure 4:
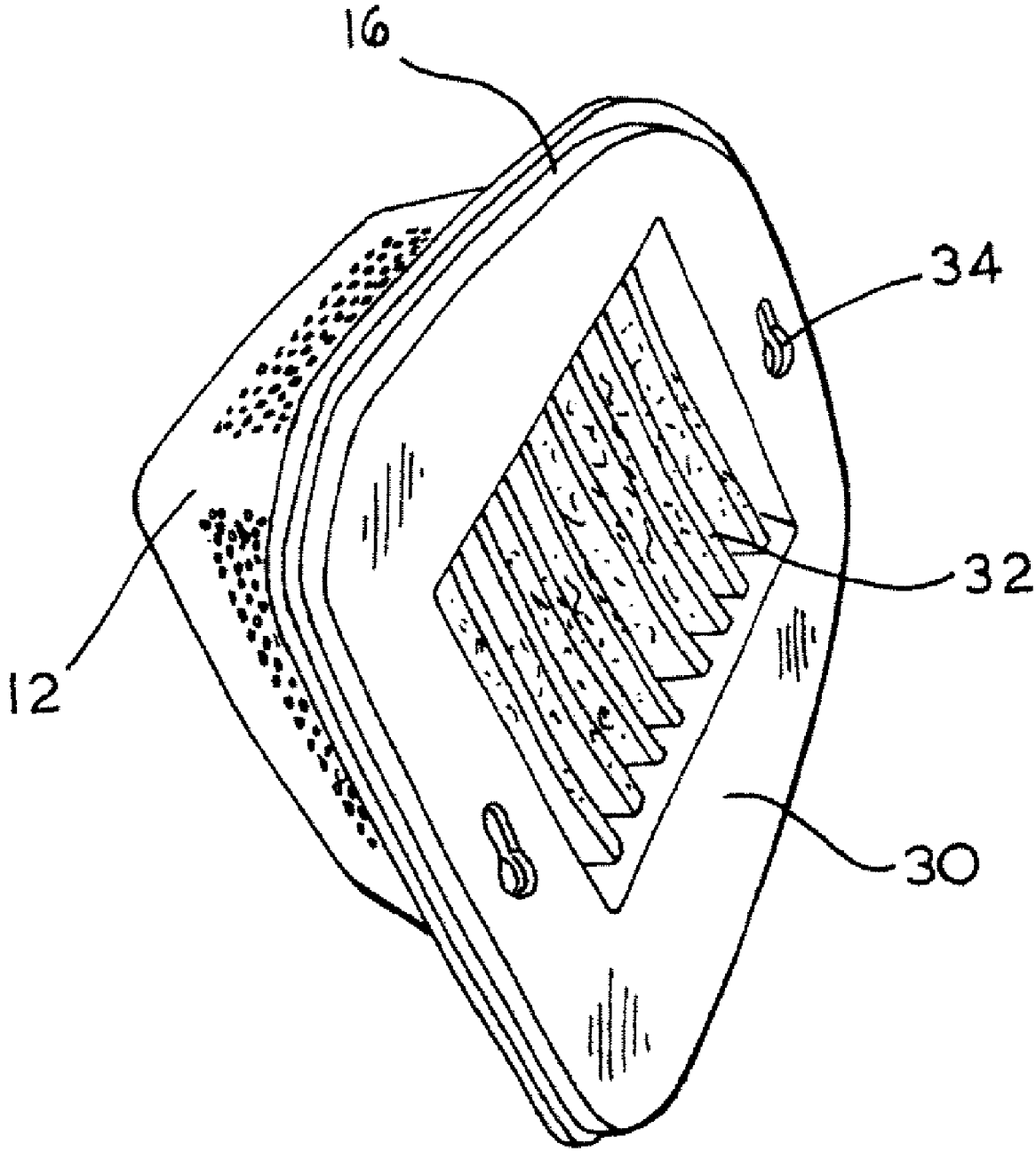
FIG. 4 is a perspective view of the filter apparatus of FIG. 1 in its assembled condition.
Figure 5:
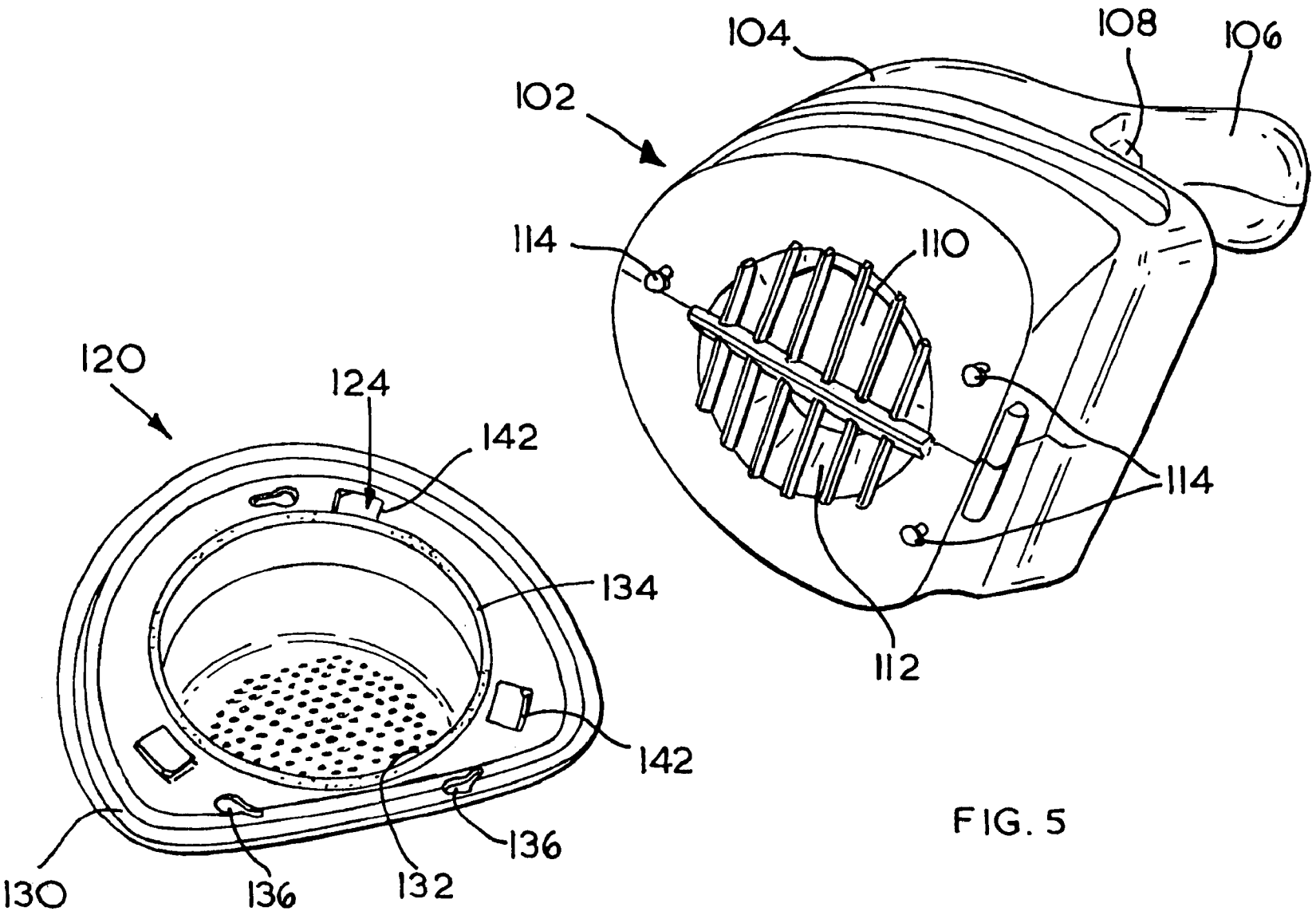
FIG. 5 is a perspective view of a filter apparatus embodying the present invention and a housing of a vacuum cleaner from which the filter apparatus has been dismounted.

Referring now to FIGS. 5 to 9, a vacuum cleaner 102 has a housing 104 and a handle 106. The housing contains a motor (not shown) which can be actuated by means of trigger switch 108 to operate a fan 110 arranged inside air inlet 112. The housing 104 is provided with a set of circumferentially spaced pins 114 arranged radially outwards of air inlet 112, each of the pins 114 having a shaft and an enlarged head.

Figure 7:
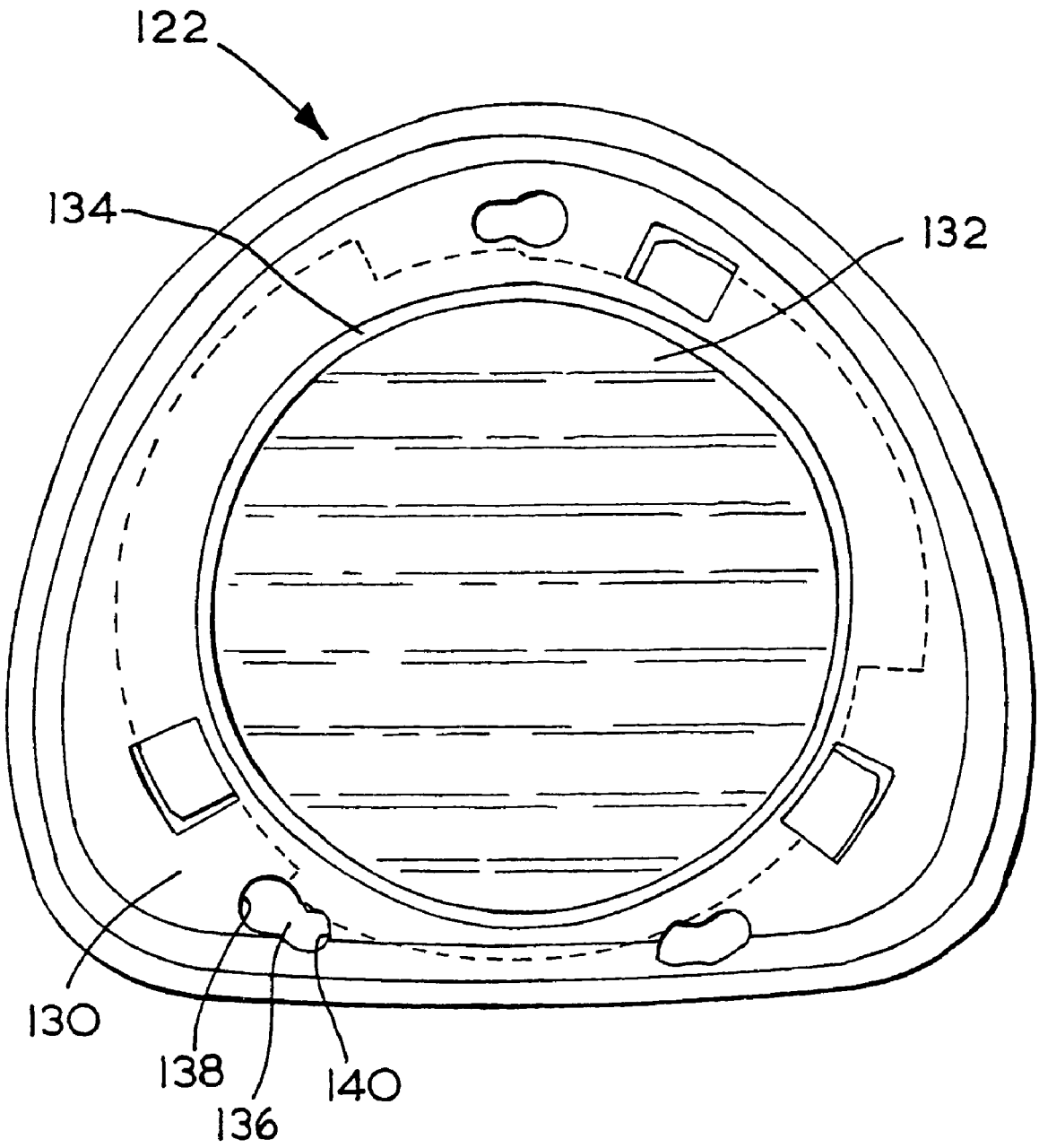
FIG. 7 is a bottom view of the assembled filter apparatus of FIG. 6.
Figure 8:
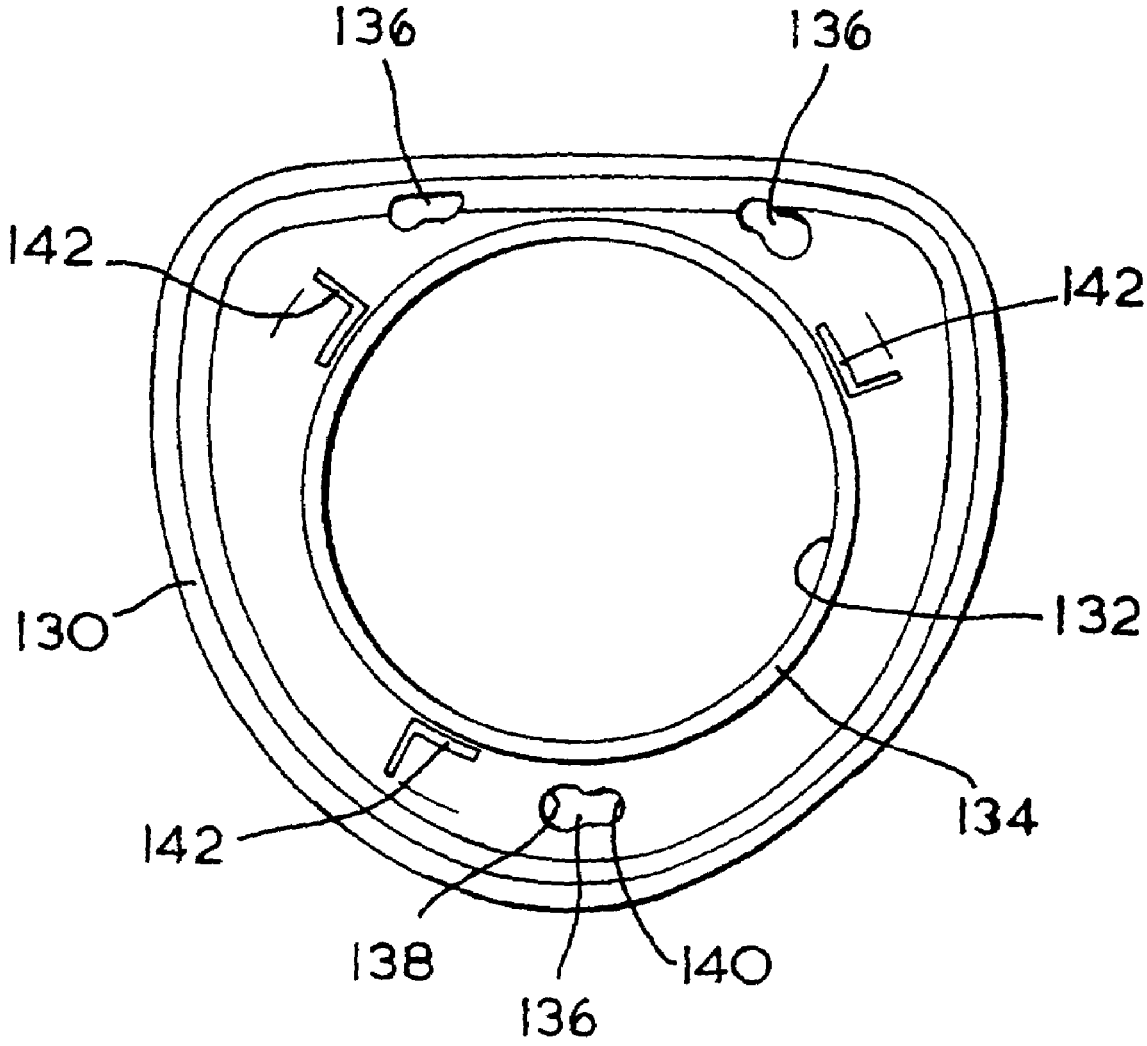
FIG. 8 is a top view of a first filter assembly of the filter apparatus of FIG. 6.
Figure 9:
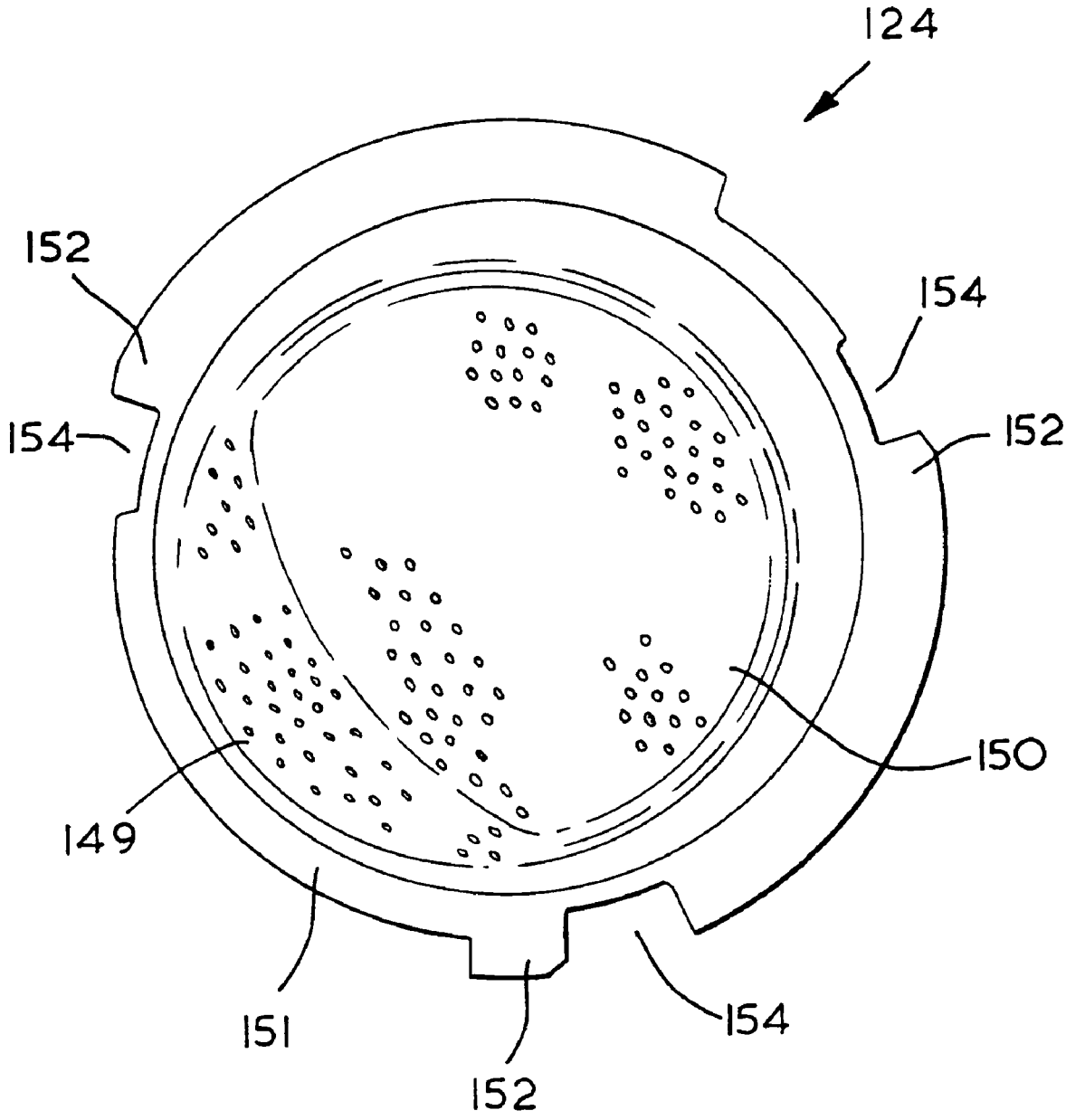
FIG. 9 is a bottom view of a second filter assembly of the filter apparatus of FIG. 6.

A filter apparatus 120 comprises a first, fine filter assembly 122 (FIG. 8) and a second, coarse filter assembly 124 (FIG. 9). Referring to FIGS. 7 and 8, fine filter assembly 122 comprises a body 130 moulded from durable plastics material and defining a central aperture 132 in which a pleated fine filter element (not shown) of suitable fibrous material which will be familiar to persons skilled in the art is arranged. The periphery of aperture 132 is surrounded by a resilient sealing member 134, which is integrally moulded with body 130 and the purpose of which will be described in greater detail below, and three apertures 136, each of which comprises a wider portion 138 and a narrower portion 140, are circumferentially arranged around body portion 130 radially outwards of aperture 132 and sealing member 134. The body 130 is also provided with radially inwardly facing slots 142 circumferentially arranged around body portion 130 radially outwards of aperture 132 and sealing member 134. The purpose of slots 142 will be described in greater detail below.

Figure 6:
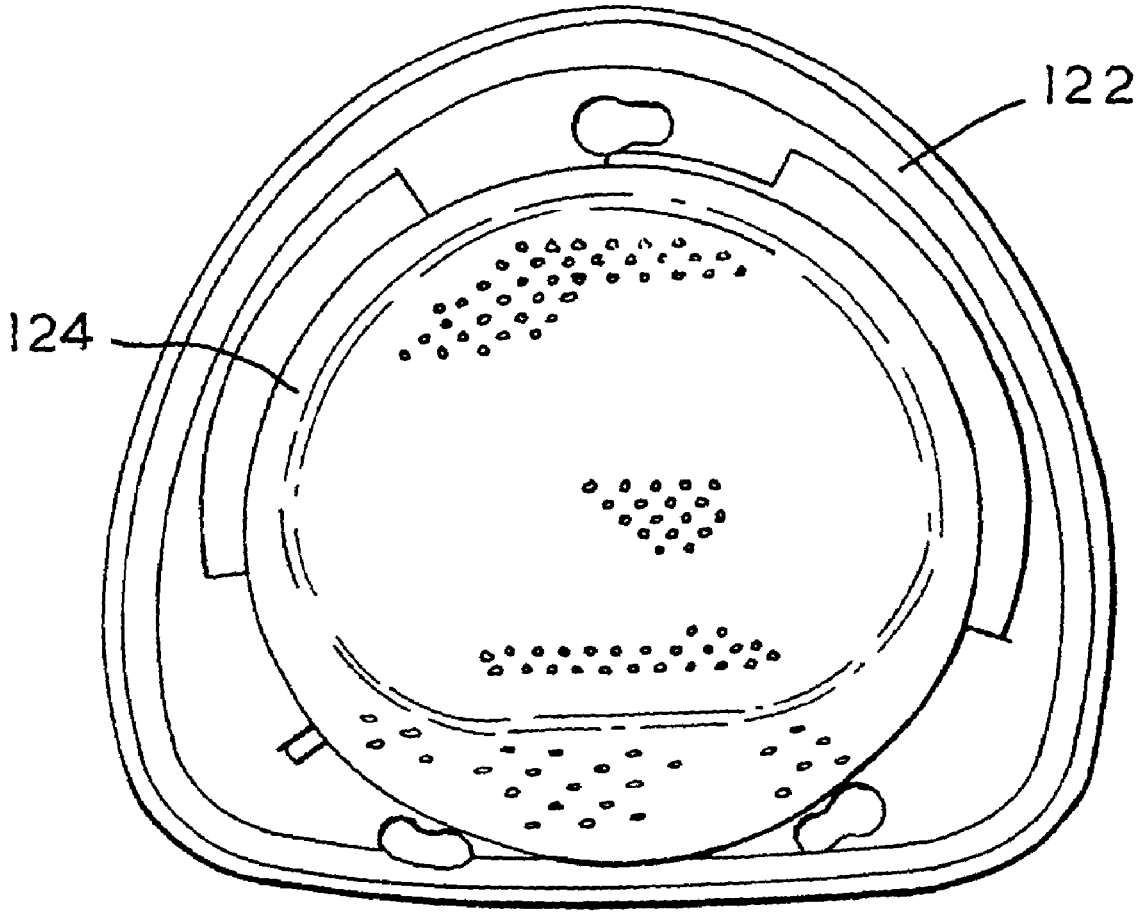
FIG. 6 is a top view of the assembled filter apparatus of FIG. 5.

Referring now to FIGS. 6, 7 and 9, coarse filter assembly 124 comprises a cup shaped body 149 having an end wall 150 and side walls 151, the end wall 150 and side walls 151 having apertures (not shown) therethrough for allowing intake of air. A series of peripheral protrusions 152 are arranged adjacent peripheral cut outs 154. The body portion 149 is shaped to receive fine filter assembly 122, and the coarse filter assembly 124 is mounted to the fine filter assembly 122 by placing the central part of fine filter assembly 122 (i.e. that part containing the fine filter element) inside body portion 149 of coarse filter assembly 124 such that apertures 136 of fine filter assembly 122 overlie cut outs 154 of coarse filter assembly 124. The filter assemblies 122, 124 are then rotated slightly relative to each other so that protrusions 152 of coarse filter assembly 124 are located within slots 142 on body portion 130 of fine filter assembly 122. The assembled filter apparatus 120 can then be mounted to housing 104 by passing the heads of pins 114 through the corresponding wider portions 138 of apertures 136 to place sealing member 134 under compression, and then rotating fine filter assembly 122 slightly relative to housing 104 to engage pins 114 with the narrower portions 140 of apertures 138 to prevent removal of the filter apparatus 120 from housing 104.

The operation of the vacuum cleaner shown in FIGS. 5 to 9 will now be described.

In order to carry out a two stage filtering process (i.e. using filtration by means of both the fine filter assembly 122 and coarse filter assembly 124), the user mounts the filter apparatus 120 comprising fine filter assembly 122 and coarse filter assembly 124 to housing 104 by engaging apertures 136 of fine filter assembly body portion 130 with pins 114 on housing 104. In order to engage the shafts of pins 114 with the narrower portions 140 of apertures 136, the sealing member 134 is placed under compression and held under compression by engagement of the heads of pins 114 with the sides of apertures 136. When the motor is actuated by means of trigger switch 108, the fan 110 draws air into air inlet 112. Because the periphery of air inlet 112 is sealed by means of sealing member 134 placed under compression by engagement of apertures 136 with pins 114, only air having passed through coarse filter assembly 124 and fine filter assembly 122 can enter air inlet 112.

In order to carry out single stage filtration (i.e. using filtration by means of the fine filter assembly 122 only in order to allow a greater rate of air flow through the vacuum cleaner than in the case of two stage filtering), the coarse filter assembly 124 is dismounted from fine filter assembly 122 by rotating coarse filter assembly 124 relative to fine filter assembly 122 so that protrusions 152 are disengaged from slots 142 to allow removal of coarse filter assembly 124. When fan 110 is actuated, because the sealing member 134 surrounding air inlet 112 is still under compression as a result of the engagement of heads of pins 114 with the periphery of narrow portions 140 of apertures 136, air cannot enter air inlet 112 without first passing through the fine filter element of fine filter assembly 122.

It is preferable that the pins 114 on the housing 104 and the protrusions 152 of coarse filter assembly 124 are shaped such that the coarse filter assembly 124 cannot be directly mounted to the housing 104 in the absence of fine filter assembly 122, but can only be mounted to fine filter assembly 122. This prevents a user from being able to operate the vacuum cleaner with only coarse filter assembly 124 mounted to housing 104, which would damage the motor of the vacuum cleaner as a result of insufficiently filtered air passing into air inlet 112.

It will be appreciated by persons skilled in the art that the above embodiment has been described by way of example only and not in any limitative sense, and that various alterations and modifications are possible without departure from the scope of the invention as defined by the appended claims. For example, it will be appreciated that as well as providing a user with a choice between single stage filtration and dual stage filtration, by use of further filter assemblies, which are mounted to the fine filter assembly 122 and/or to the coarse filter assembly 124, three or more stage filtration can be carried out. Since the sealing member 134 of fine filter assembly 122 prevents unfiltered air from entering air inlet 112 of the vacuum cleaner without first passing through a fine filter element of the fine filter assembly 122, the third and subsequent filter assemblies do not need to be provided with additional sealing members. The third and subsequent filter assemblies can have various degrees of fineness of filtration, for example less fine than fine filter assembly 122, and more or less fine than coarse filter assembly 124. Again, it will be appreciated by persons skilled in the art that in a manner similar to coarse filter assembly 124, the third and subsequent filter assemblies may be provided with fittings to prevent them from being directly mounted to the pins 114 on housing 104, to prevent operation of the vacuum cleaner when fine filter assembly 122 is not present, thus minimising the risk of damage to the motor.

The invention claimed is:

1. A first filter assembly for a vacuum cleaner having a housing, at least one air inlet, at least one air outlet, and suction means for causing air to flow from at least one said inlet to at least one said outlet, the first filter assembly comprising:

a body portion having at least one first aperture and at least one filter element arranged in said first aperture for substantially preventing passage of particles larger than a first predetermined particle size;

first mounting means on said body portion for enabling the body portion to be removably mounted to the housing of the vacuum cleaner;

second mounting means for enabling a second filter assembly to be removably mounted to said body portion;

sealing means for preventing passage of air into the suction means of the vacuum cleaner without previously having passed through said filter element;

wherein said second mounting means comprises at least one slot or protrusion on said body portion for engaging a respective said protrusion or slot on the second filter assembly, and the second filter assembly is secured to the body portion by rotating the second filter assembly with respect to the body portion.

2. An assembly according to claim 1, wherein the first mounting means comprises at least one aperture or pin on said body portion adapted to engage a respective pin or aperture on the housing.

3. An assembly according to claim 2, wherein said at least one aperture comprises a first portion for enabling removal of the pin from the corresponding said aperture when engaged therewith, and a second portion, narrower than said first portion, for preventing removal of the pin from the corresponding said aperture when engaged therewith.

4. An assembly according to claim 2, wherein the sealing means surrounds said aperture or pin of said first mounting means.

5. An assembly according to claim 2, wherein the first mounting means comprises a plurality of said apertures or pins circumferentially spaced around said body portion.

6. An assembly according to claim 1, wherein the sealing means comprises at least one resilient member surrounding said first aperture.

7. An assembly according to claim 6, wherein the sealing means comprises a single said resilient member surrounding said first aperture.

8. An assembly according to claim 1, wherein the first mounting means prevents the second filter assembly from being mounted thereto.

9. An assembly according to claim 1, wherein the second mounting means prevents the second filter assembly from being mounted directly to the housing of the vacuum cleaner.

10. A second filler assembly for a vacuum cleaner having a housing, at least one air inlet, at least one air outlet, and suction means for causing air to flow from at least one said inlet to at least one said outlet, the second filter assembly comprising:

a body portion having a plurality of apertures for substantially preventing passage of particles larger than a second predetermined particle size;

a mounting means provided on said body portion for enabling the body portion to be removably mounted to a first filter assembly adapted to be mounted to the housing of the vacuum cleaner such that air having passed through said second filter assembly is prevented from passing into said suction means without first passing through the first filter assembly; and wherein the second filter assembly is mounted to the first filter assembly by rotating the second filter assembly with respect to the first filter assembly.

11. An assembly according to claim 10, wherein the mounting means comprises a plurality of protrusions or slots on said body portion adapted to engage respective slots or protrusions on the first filter assembly, the body portion having cutouts so that the first filter assembly mounting means passes through said cutouts when the second filter assembly is placed over the first filter assembly.

12. A filter apparatus for a vacuum cleaner having a housing, at least one air inlet, at least one air outlet, and suction means for causing air to flow from at least one said inlet to at least one said outlet, the filter apparatus comprising:

a first filter assembly adapted to substantially prevent passage of particles larger than a first predetermined particle size;

a second filter assembly adapted to substantially prevent passage of particles larger than a second predetermined particle size, larger than said first predetermined particle size, wherein said second filter assembly is adapted to be removably mounted to said first filter assembly; and wherein the second filter assembly includes protrusions that rotatably engage slots on the first filter assembly.

13. The filter apparatus for a vacuum cleaner according to claim 12 wherein the first filter assembly includes a mounting member that engages a corresponding mounting member on the housing, and the second filter assembly includes a mounting member that engages a corresponding mounting member on the first filter assembly.

14. The filter apparatus for a vacuum cleaner according to claim 12 wherein the mounting member of the first filter assembly includes an aperture having a first portion and a second portion, the second portion narrower than the first portion, the aperture engaging a pin on the housing to mount the first filter assembly thereto.

15. The filter assembly of claim 12 wherein the second filter assembly has cutouts that allow the mounting member of the first filter assembly to pass through when the second filter assembly is mounted to the first filter assembly.

* * * * *